United States Patent [19]

Cond

[11] 4,093,685

[45] June 6, 1978

[54] PRODUCTION OF SURFACING UNITS

[75] Inventor: Frederick George Cond, Sutton Coldfield, England

[73] Assignee: Ibstock Building Products Limited, Leicester, England

[21] Appl. No.: 750,399

[22] Filed: Dec. 14, 1976

[30] Foreign Application Priority Data

Dec. 23, 1975 United Kingdom ..... 52687/75

[51] Int. Cl.[2] ..... B05B 3/00

[52] U.S. Cl. ..... 264/28; 264/71; 264/261; 264/313; 264/316

[58] Field of Search ..... 264/28, 261, 313, 316, 264/71

[56] References Cited

U.S. PATENT DOCUMENTS

| | | | |
|---|---|---|---|
| 1,809,504 | 6/1931 | Carvel | 264/313 X |
| 3,032,850 | 5/1962 | Russell | 264/28 X |
| 3,629,384 | 12/1971 | Elgenstierna | 264/261 X |
| 4,001,365 | 1/1977 | Graham | 264/261 X |

*Primary Examiner*—Thomas P. Pavelko

*Attorney, Agent, or Firm*—Larson, Taylor and Hinds

[57] ABSTRACT

The invention is concerned with the problem of holding in place a plurality of bricks, stones, tiles or the like while they are being assembled into a pre-formed panel for subsequent incorporation into a building or like structure. It has been discovered that the elements can be frozen into place on a water-saturated base surface without any detrimental effect on the setting characteristics of the mortar or other adhesive used to bind the elements. The invention also provides apparatus for carrying out the method.

7 Claims, 2 Drawing Figures

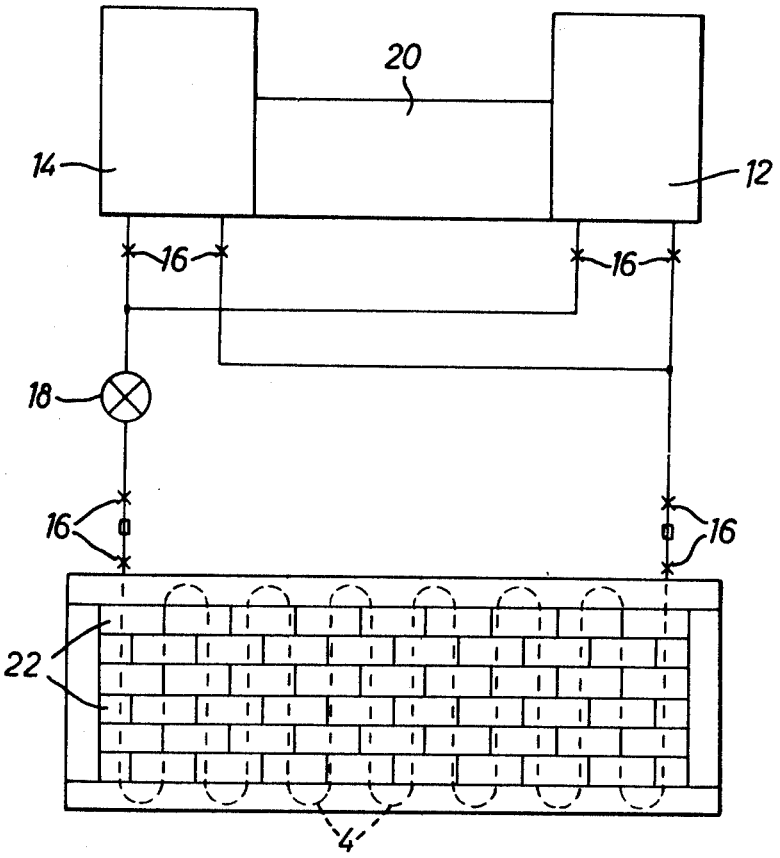
FIG. 1
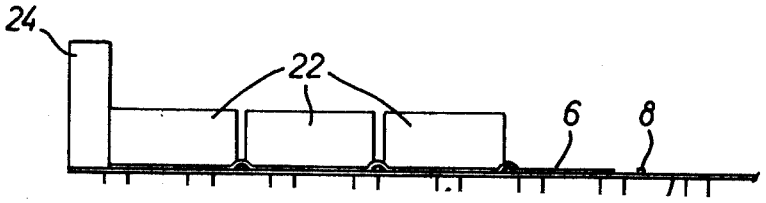

PRODUCTION OF SURFACING UNITS

BACKGROUND OF THE INVENTION

This invention is concerned with improvements in or relating to the production of surfacing units composed of a plurality of elements of brick, tile, stone or the like and connected by fillets of suitable mortar or other adhesive.

In the production of surfacing units it is known to arrange the component elements in the desired pattern on a base and to maintain them in their correct position, while the gaps between the adjacent edges are filled with mortar or other adhesive, for example by means of suction. The elements are usually placed face-down on the base and, in this way, the accidental application of mortar to the viewable faces is avoided.

While this technique is satisfactory for elements which have a smooth regular surface, obvious difficulties in achieving a satisfactory degree of partial vacuum between the elements and the base are experienced where the elements are provided with a raised pattern or are rough in texture, for example, as in so-called crazypaving. Moreover, where the surfacing unit comprises a corner piece having portions at right angles to other portions thereof, the use of vacuum on such a unit will result in damage to the partially set mortar when the vacuum is released because of the difference in the direction of "spring" between the portions.

BRIEF SUMMARY OF THE INVENTION

The present invention therefore provides a method of producing surfacing units composed of a plurality of elements of brick, tile, stone or the like connected by fillets of suitable mortar or other adhesive, comprising the steps of procuring a base member comprising a surface covering of deformable saturable material, saturating said material with water or a suitable freezing liquid, laying the elements thereon in a desired pattern, said base member being provided with freezing means whereby the water or liquid in said material is caused to freeze and thereby secure the elements in place while the mortar or adhesive is applied to the gaps between edge surfaces of adjacent elements, subsequent thawing of the water or liquid releasing the surfacing unit from the base member.

It has been found that the use of the above described technique in no way impairs the strength of the mortar bond between elements of the surfacing units. This appears to be because the freezing of the mortar occurs before any setting, physical or chemical, takes place. The damage to mortar or concrete which is attributable to frost from the water in the mortar freezing after hardening or setting has commenced. We have found that mortar, if it becomes frozen immediately after mixing, shows no impairment of hardening or strength characteristics when it has been thawed out.

The invention therefore further provides apparatus for the production of surfacing units according to the method described above, comprising a base member provided with temperature control means capable of reducing the surface temperature thereof to below the freezing point of water, the surface of said base member being covered or adapted to be covered with a layer of deformable, saturable material, said temperature control means being further capable of increasing the surface temperature of the base member to a temperature substantially above the freezing point of water.

Conveniently, the surface of the base member may be provided with an under layer of polyurethane foam sheet material having, if desired, an outer layer of stretch fabric, for example knitted from high bulk polyester yarn.

Alternatively, the surface of the base member may be provided with a layer of water-saturated sand or other granular material.

The temperature control means may comprise a plurality of conduits arranged below the surface of the base member and means for supplying these with a freezing mixture, for example glycol, or brine, or with hot water as required. Conveniently there is provided a supply pipe having a valve capable of connection to a reservoir of freezing liquid, for example an ethylene glycol solution at −20° C, or to a hot water tank.

By turning a portion of the base member with the elements frozen in place through an angle, say, 90° , a further set of elements may be frozen in place on a second portion of the base member and secured in position adjacent an edge of the first set of elements in a plane at 90° thereto to form a corner unit.

BRIEF DESCRIPTION OF THE DRAWINGS

There will now be described, with reference to the accompanying drawings, an apparatus according to the invention. It will be understood that the description is given by way of example only and not by way of limitation.

In the drawings:

FIG. 1 shows a plan view of the apparatus; and

FIG. 2 shows a portion of the apparatus in side elevation.

DETAILED DESCRIPTION OF THE DRAWINGS

A steel base member 2 is provided on a lower surface thereof with a system of conduits in the form of pipes 4 carrying cooling or heating fluid to control the temperature of the upper surface of the member 2. In the present example, the upper surface is covered by a layer of polyurethane foam 6. A grid-like pattern of ridges 8 is provided on the upper surface of the base member for reasons to be explained below.

Supply pipes 10 provide the pipe system 4 with a freezing glycol solution from a cooling tank 12 or with a heated glycol solution from a tank 14, according to the settings of valves 16, the flow being maintained by means of a pump 18. Reference numeral 20 denotes the refrigeration unit.

In use, the foam layer 6 is saturated with water by, for example, spray means, prior to the placing of a plurality of bricks 22 on the foam so that the gaps in between the bricks correspond with the grid-like pattern of ridges 8. A wooden frame member 24 surrounds the outermost rows of bricks and ensures a regular edge surface to the panel to be formed from the bricks.

The valves 16 are then set to admit a freezing glycol solution to the system of pipes 4. The water in the layer 6 freezes and the bricks are held firmly in place. The bricks being of an absorbent nature will have absorbed a quantity of the water before it freezes, but in the event that too much water is likely to be absorbed, a small quantity of methyl cellulose may be added to the water, or alternatively the bricks may be wetted beforehand.

Mortar is then placed in the gaps between the bricks and consolidated by vibrating the assembly by a vibratory device (not shown). It will be appreciated that the ridges 8 project a little way into the gaps and therefore the mortar fillet formed in each gap has an outer surface, when in use, which is pleasingly recessed to simulate the mortar bond of a conventionally built brick wall.

On completion of the mortar-filling operation, the valves 16 are appropriately reversed to cause a heated glycol solution to pass through the pipes 4 to raise the temperature of the water in the foam 6 to above 0° C so as to free the bricks 22 from the base member 2.

The risk of physical damage to the mortar bonds is minimised since the assembled panel does not "spring" when released from ice as would a similar panel held in place by suction. After an adequate time has elapsed for the mortar to harden, the panel and the frame member are lifted from the base member to complete the hardening. If sufficiently low temperatures are used, for example −20° C, the freezing step only takes a matter of minutes and is accomplished before the low temperature has a significant effect on the mortar, i.e. before it commences to harden. Moreover, the exposed face of the bricks (the rear surface of the finished panel), and the adjacent mortar, is not affected by the freezing.

Panels having irregular surface finishes may be assembled by using water-saturated sand instead of the foam 6. The bricks are embedded in the sand, with the aid of vibration if necessary, and frozen into place as described above. When the panel is de-moulded and released from the frame, the viewable surface of the panel is hosed down to leave it clean and free from mortar staining.

Various modifications may be made within the scope of the invention as defined by the following claims.

I claim:

1. A method of producing surfacing units composed of a plurality of elements of brick, tile, stone or the like connected by fillets of suitable mortar or other adhesive, comprising the steps of procuring a base member comprising a surface covering of deformable saturable material, saturating said material with a freezable liquid consisting essentially of water, laying the elements thereon in a spaced desired pattern such that the deformable material projects into the gaps between adjacent elements in the shape of a ridge, said base member being provided with freezing means whereby the water in said material is caused to freeze and thereby secure the elements in place while the mortar or adhesive is applied to the gaps between edge surfaces of adjacent elements above the deformable material in the gaps, subsequent thawing of the water releasing the surfacing unit from the base member.

2. A method as claimed in claim 1 in which the saturable material is an absorbent foamed plastics material and is saturated by spraying with water.

3. A method as claimed in claim 1 in which, when the elements are themselves of an absorbent nature, a quantity of a thickening agent is added to the water.

4. A method as claimed in claim 3 in which the agent is methyl cellulose.

5. A method as claimed in claim 1 in which the base member is covered with a layer of sand which is then saturated with water.

6. A method as claimed in claim 1 in which the base member is vibrated with the elements positioned thereon, prior to freezing of the water.

7. A method as claimed in claim 1 in which a first base member or portion thereof may be arranged, after freezing the elements in place, to lie adjacent a second base member or portion and at an inclined angle thereto so as to permit further elements to be assembled on said second member or portion to produce a corner surfacing unit.

* * * * *